US009426557B2

(12) United States Patent
Son

(10) Patent No.: US 9,426,557 B2
(45) Date of Patent: Aug. 23, 2016

(54) EARPHONE SYSTEM, EARPHONE DEVICE, AND PORTABLE TERMINAL FOR SUPPORTING THE SAME

(71) Applicant: Samsung Electronics Co. Ltd., Suwon-si, Gyeonggi-do (KR)

(72) Inventor: Kyungdae Son, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 489 days.

(21) Appl. No.: 13/943,040

(22) Filed: Jul. 16, 2013

(65) Prior Publication Data

US 2014/0023202 A1 Jan. 23, 2014

(30) Foreign Application Priority Data

Jul. 18, 2012 (KR) ..... 10-2012-0078127

(51) Int. Cl.
*H04R 1/10* (2006.01)
*H04R 29/00* (2006.01)

(52) U.S. Cl.
CPC ..... *H04R 1/1066* (2013.01); *H04R 29/00* (2013.01); *H04R 2420/05* (2013.01)

(58) Field of Classification Search
CPC ..... H04R 3/00; H04R 1/00; H04R 1/10; H04R 1/1091; H04R 1/1041; H04R 1/06; H04R 5/04; H04R 5/033; H04R 25/00; H04R 25/405; H04R 25/407; H04R 25/453; H04R 25/556; H04R 1/1066; H04R 29/00; H04N 5/60; H04M 1/02; H04M 1/03; H01R 13/70; H01R 24/58; G06F 1/1616; G06F 1/1658; G06F 3/16
USPC ..... 381/74, 314, 323, 309, 73.1, 334, 91, 381/122, 111–117; 700/94
See application file for complete search history.

(56) References Cited

U.S. PATENT DOCUMENTS

2005/0105718 A1* 5/2005 Hansen ..... H04B 1/64 379/390.01
2005/0201568 A1* 9/2005 Goyal ..... H04M 1/6058 381/74
2009/0175456 A1* 7/2009 Johnson ..... H04S 7/308 381/1
2012/0051554 A1* 3/2012 Modi ..... H04R 5/04 381/74

* cited by examiner

*Primary Examiner* — Leshui Zhang
(74) *Attorney, Agent, or Firm* — Jefferson IP Law, LLP

(57) ABSTRACT

An earphone device, a portable terminal and an earphone system are provided. The earphone system includes a portable terminal having an earphone interface, an earphone device electrically connectable to the earphone interface, and at least one device recognition element which is disposed in at least one of the earphone interface and the earphone device and which provides a certain resistance value when the earphone device is electrically connected to the earphone interface so that the portable terminal determines that the earphone device is electrically connected to the earphone interface.

5 Claims, 6 Drawing Sheets

EARPHONE SYSTEM, EARPHONE DEVICE, AND PORTABLE TERMINAL FOR SUPPORTING THE SAME

PRIORITY

This application claims the benefit under 35 U.S.C. §119 (a) of a Korean patent application filed on Jul. 18, 2012 in the Korean Intellectual Property Office and assigned Serial No. 10-2012-0078127, the entire disclosure of which is hereby incorporated by reference.

BACKGROUND OF THE INVENTION

1. Field of the Invention

The present invention relates to an earphone contact support. More particularly, the present invention relates to an earphone system, an earphone device, and a portable terminal for supporting the same, in which an element that recognizes an earphone contact is disposed in at least one of an earphone device and a portable terminal, thereby normally supporting an audio signal process even if an abnormality is partially generated in the earphone device.

2. Description of the Related Art

Recently, portable terminals have been more widely used due to their mobility. Mobile communication terminals, which allow users to perform a voice communication wirelessly and/or while moving, have been very popular. On the other hand, the mobile communication terminals have various functions as well as an important function for transmission and reception of communication information between users. For example, the related-art portable terminals have a digital audio function corresponding to a music file reproduction function, and an image collection function corresponding to a digital camera. Furthermore, the related-art portable terminals have supported a function for execution of mobile games, arcade games, and the like.

On the other hand, related-art portable terminals have provided an earphone system for allowing a user to listen to audio signal reproduced by the related-art mobile terminal more conveniently and which prevents a user from causing inconvenience to other people during audio reproduction, or allows the user to enjoy listening to audio alone. Accordingly, the user may listen to music or watch TV using an earphone system, regardless of a time and a place. Here, the related-art earphone system of a portable terminal detects a connection of an earphone on the condition that a head of an earphone device comes in electrical contact with an earphone contact interface of the portable terminal. In the related-art earphone system, the portable terminal detects an electrical change caused by a connection of a structure of the earphone device to an earphone contact interface when the earphone device is inserted in the earphone contact interface of the portable terminal.

However, the related-art earphone system may have difficulty in supporting a normal function of the earphone device because of abnormalities generated in a certain portion of the earphone device may prevent suitable detection of the electrical change. Where the earphone device has employed a pair of ear-speakers, which respectively have a predetermined size and weight and are respectively connected to each end of narrow and long wires, the corresponding structures of the earphone device is physically weak in comparison with other structures, for example, a head, a control module, and the like. Accordingly, when an abnormality, such as a short-circuit, is generated in the ear-speakers, the portable terminal may not perform a normal function of detecting an electrical change between the corresponding ear-speakers and the earphone contact interface to recognize the connection of the earphone device. The short circuit of the ear-speakers may be generated in various environments in which the earphone is used, regardless of a shape of the earphone device. This problem may prevent a user from using the corresponding earphone device even though other parts of the earphone device may be used, regardless of the generation of abnormality in a part of the earphone device. This problem lays a burden on the user in view of cost because a price of an earphone device gradually increases as users desire to listen to more high quality audio by using more high quality earphone devices.

Further, a user may wear and use only one certain ear-speaker of two ear-speakers in order to keep listening to or pay attention to a surrounding environment while listening to audio. In this case, the ear-speaker that is not worn and/or used may be subjected to impact from other matters around the user easily, resulting in frequent malfunctions of the ear-speakers. If the ear-speaker that is not worn is an important structure necessary for identification of the corresponding earphone device, then the corresponding ear-speaker may not be used and also the earphone device may not be used. Therefore, there is a problem in that a user may not use the earphone device itself as the user may not use a failed ear-speaker.

The above information is presented as background information only to assist with an understanding of the present disclosure. No determination has been made, and no assertion is made, as to whether any of the above might be applicable as prior art with regard to the present invention.

SUMMARY OF THE INVENTION

Aspects of the present invention are to address at least the above-mentioned problems and/or disadvantages and to provide at least the advantages described below. Accordingly, an aspect of the present invention is to provide an earphone system, an earphone device, and a portable terminal which are capable of stably recognizing a connection of the earphone device and supporting functions of the earphone device.

In accordance with an aspect of the present invention, an earphone device is provided. The earphone device includes an earphone head which has a plurality of terminals, at least one earphone output unit which is connected to the earphone head and outputs audio signals using an ear-speaker, and a device recognition element connected to one of the earphone head and the at least one earphone output unit, the device recognition element recognizing the earphone device.

In accordance with another aspect of the present invention, a portable terminal for supporting an earphone device is provided. The portable terminal includes an earphone interface which is electrically connectable to the earphone device, a controller determining whether the earphone device is electrically connected to the earphone interface according to a signal transmitted from the earphone interface, and an audio processor supporting functions of the earphone device under a control of the controller, wherein the earphone interface includes terminal connectors connectable to a head of the earphone device, an element connector connectable to a certain terminal of the earphone head and a device recognition element that is connected to the element connector when the earphone head is electrically connected to the earphone interface, a recognition connector connected to the certain terminal in order to determine whether the earphone device is electrically connected to the earphone interface, a distribution resistor connected to the recognition connector in order to distribute a pull-up voltage together with the recognition connector, and a comparator connected to the distribution resistor.

In accordance with another aspect of the present invention, an earphone system is provided. The earphone system includes a portable terminal having an earphone interface, an earphone device electrically connectable to the earphone interface, and at least one device recognition element which is disposed in at least one of the earphone interface and the earphone device and which provides a certain resistance value when the earphone device is electrically connected to the earphone interface so that the portable terminal determines that the earphone device is electrically connected to the earphone interface.

As described above, with relation to the earphone system, the earphone device and the portable terminal according to aspects the present invention, the present invention may stably and securely recognize the connection between the earphone device and the portable terminal, and may support a process of determining whether the connection of the earphone device is present even though an abnormality is generated in the earphone device.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

Figure 1:
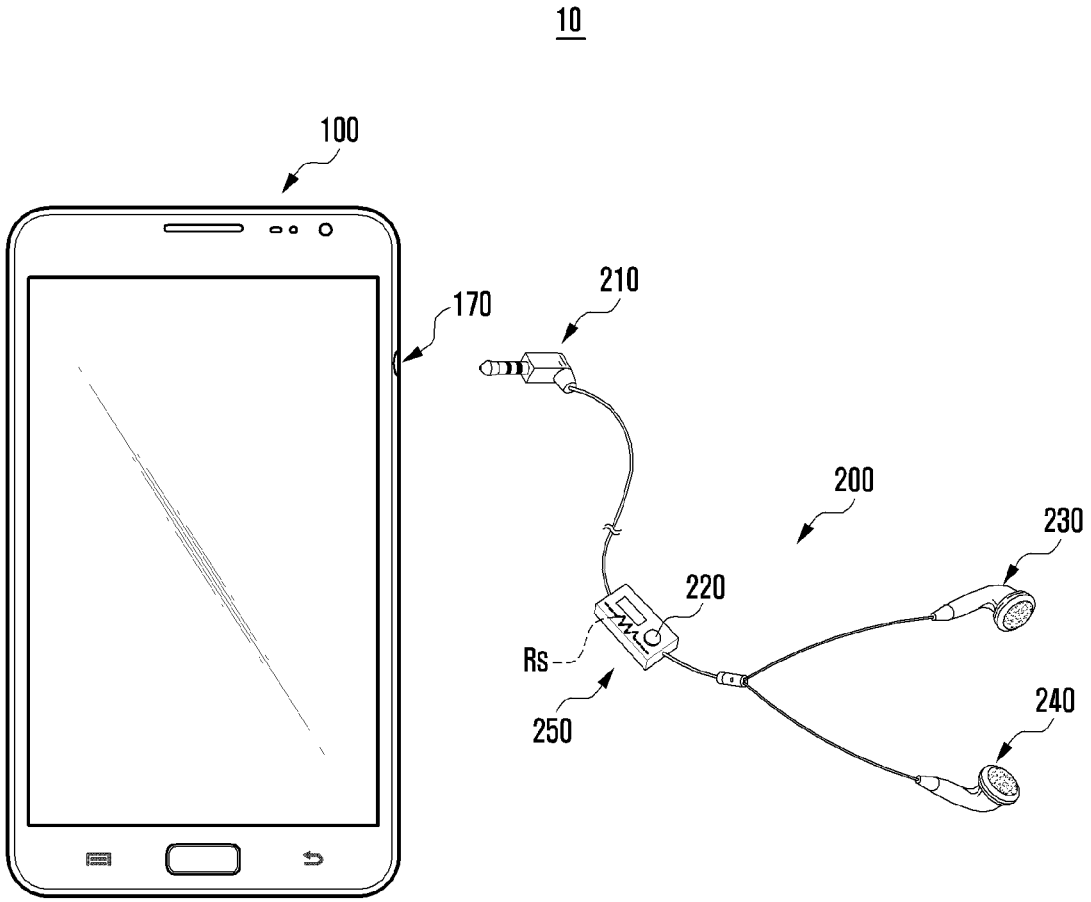
FIG. 1 is a schematic view illustrating a configuration of an earphone system according to an exemplary embodiment of the present invention.

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Likewise, some structural elements are enlarged, omitted, or schematically shown in the accompany drawings. The substantial size of each structural element is not wholly reflected in the size of the structural element in the drawings. Accordingly, the present invention is not limited by a relative size and arrangement of the structural elements in the accompanying drawings.

Figure 2:
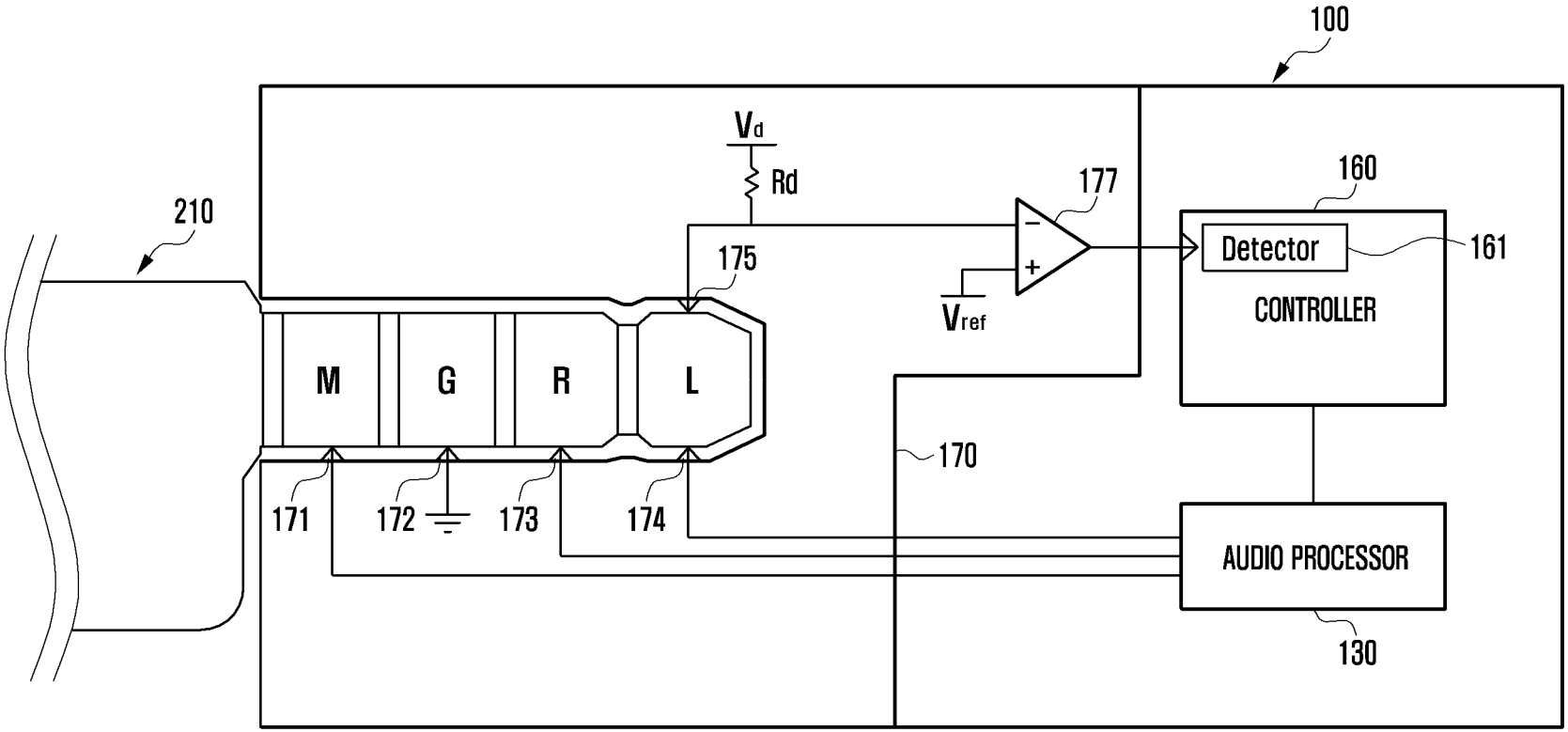
FIG. 2 is a view illustrating a configuration of an earphone interface of a portable terminal and a head of an earphone device in an earphone system according to an exemplary embodiment of the present invention.

FIG. 1 is a schematic view showing a configuration of an earphone system 10 according to an exemplary embodiment of the present invention, and FIG. 2 is a view illustrating a configuration of an earphone interface of a portable terminal and a head of an earphone device in an earphone system according to an exemplary embodiment of the present invention.

Referring to FIGS. 1 and 2, an earphone system 10 of the present exemplary embodiment includes a portable terminal 100 and an earphone device 200. In the earphone system 10 of the present exemplary embodiment, at least one device recognition element Rs is disposed in the earphone device 200 and/or the portable terminal 100. Accordingly, while the earphone device 200 is inserted into the portable terminal 100 such that the earphone device 200 and the portable terminal are electrically connected, the portable terminal 100 may recognize a contact of the earphone device 200 regardless of a partial malfunction of the earphone device 200, so as to support at least one function of an audio signal output and an audio signal collection based on the recognition of the malfunction.

Here, the earphone device 200 may include an earphone head 210 inserted in an earphone interface 170 of the portable terminal 100 such that the earphone head 210 and the earphone interface are electrically connected, and earphone output units 230 and 240 connected to the earphone head 210 to output audio. Furthermore, the earphone device 200 may include a microphone 220, and may also include a case having the microphone 220 and a control module 250 having a printed circuit board and the like to generate input signals of the earphone device 200.

The earphone head 210 may have three or four terminals. However, the present invention is not limited thereto, and the earphone head 210 may have any suitable number of terminals. That is, the earphone head 210 includes a left terminal L of the earphone, a right terminal R of the earphone, and a ground terminal G of the earphone. Further, the earphone head 210 may also include a microphone terminal M. Such an earphone head 210 has a cylindrical shape with a predetermined diameter, and may be detachably connected to the earphone interface 170. That is, the earphone head 210 may be connected to and separated from the earphone interface 170 by a physical force and/or user action. When the earphone head 210 comes in contact with a certain terminal of the earphone interface 170, a resistance value of the device recognition element Rs connected to the earphone device 200 may be provided to a certain circuit device of the portable terminal 100. In other words, the earphone head 210 may function as a structural part which recognizes a certain path so that the portable terminal 100 may recognize an insertion of the earphone device 200.

The earphone output units 230 and 240 may be designated as an earphone left output unit 230, which is connected to the left terminal L of the earphone and outputs audio signals of a left side or track of an audio signal, and an earphone right output unit 240, which is connected to the right terminal R of the earphone and outputs audio signals of a right side or track of an audio signal. However, the present invention is not limited thereto, and the left terminal L and the right terminal R may output any suitable and or similar audio signal and/or track such as a mono signal or a multi-track signal. More specifically, the earphone output units 230 and 240 may distinguish and output right and left audio signals when the audio signals are in a stereo type, an output the audio signals without a separation of right and left when the audio signals are in a mono type. Here, the earphone left output unit 230 has a predetermined resistance value of several tens of ohms, for example, a resistance value of 32 ohms. The earphone right output unit 240 also has a predetermined resistance value of 32 ohms which corresponds to a resistance value of an earspeaker. However, the present invention is not limited thereto, and the earphone left output unit 230 and the earphone right output unit 240 may have any suitable and/or similar resistance value.

More specifically, the earphone left output unit 230 and the earphone right output unit 240, as described above, may have a different resistance value according to the property of earspeakers in the corresponding earphone device 200. That is, depending on specifications of audio outputs which the earphone device 200 supports, materials used for supporting corresponding specifications may be varied. Accordingly, the predetermined resistance value of each earphone output unit 230 or 240 can be varied according to the properties of materials, and an arrangement and a delicacy of elements.

The control module 250 is disposed between the earphone head 210 and the earphone output units 230 and 240, connects respective terminals of the earphone head 210 to respective output parts of the earphone output units 230 and 240, and provides a space in which a microphone 220 is disposed. The control module 250 may further include buttons according to whether functions of the earphone device 200 are supported. The control module 250 may generate corresponding input signals when the buttons are actuated, and transmit the input signals to the controller 160 of the portable terminal 100 through the earphone interface 170 connected to the earphone head 210.

Such a control module 250 has the device recognition element Rs between a terminal of the earphone head 210 and the earphone output units 230 and 240. Therefore, even if the earphone output units 230 and 240 malfunction, the portable terminal 100 may recognize the earphone device 200, thereby supporting an audio output function of the earphone device 200. The device recognition element Rs may be disposed at a certain location in the present exemplary embodiments. That is, the device recognition element Rs may be connected to the earphone left output unit 230, the earphone right output unit 240, or both earphone the left and right output units 230 and 240. On the other hand, when the portable terminal 100 is to identify the contact of the earphone device 200 by detecting the terminal connection of the microphone, the device recognition element Rs may be connected in parallel to the microphone 220 in the control module 250. The connection of the device recognition element Rs will be described in detail with reference to the accompanying drawings.

The portable terminal 100 includes the earphone interface 170 in which the earphone device 200 is inserted, and also includes a controller 160, and an audio processor 130. The portable terminal can additionally include a communication unit and a storage unit. The portable terminal 100 recognizes the device recognition element Rs, which is disposed at a certain location of the earphone device 200, in order to identify the earphone device 200 when the earphone head 210 comes in contact with the earphone interface 170, so as to recognize the contact of the earphone device 200.

More particularly, since the portable terminal 100 of the present exemplary embodiment is configured to recognize the contact of the earphone device 200 by determining the predetermined resistance of the earphone output units 230 and 240 of the earphone device 200, the device recognition element Rs may be disposed in at least one of the earphone output units 230 and 240 so as to stably support the portable terminal 100 recognizing the contact of the earphone device 200. For example, the portable terminal 100 may recognize the predetermined resistance of the earphone left output unit 230 when the earphone output units 230 and 240 are connected to the portable terminal. Accordingly, even if the earphone left output unit 230 has a short-circuit, the portable terminal 100 may identify the resistance value of the device recognition element Rs since the device recognition element Rs is disposed on a connection line of the earphone left output unit 230. Therefore, the portable terminal 100 identifies the contact of the earphone device 200 based on the resistance value of the device recognition element Rs, thereby performing a support for functions of the earphone device 200.

On the other hand, though the earphone left output unit 230 has no problem such as the short-circuit, the portable terminal 100 may determine parallel resistance values, including the resistance value of the device recognition element RS disposed in the earphone left output unit 230 and the predetermined resistance value of the earphone left output unit 230, through the earphone interface 170. Accordingly, since the predetermined resistance value of the earphone left output unit 230 and the parallel resistance value are provided to the portable terminal 100 when the resistance value of the device recognition element Rs is appropriately adjusted, the portable terminal 100 may recognize the earphone device 200, and may perform the functional support of the earphone device 200.

The earphone interface 170 includes an insertion hole in which the earphone head 210 is inserted, and includes a predetermined number of terminal connectors on an inner surface of the insertion hole in order to support the connection of the earphone device 200 having three or four terminals or a number of terminals corresponding to the predetermined number of terminal connectors. The earphone interface 170 includes the terminal connectors 171, 172, 173 and 174, for respectively recognizing respective terminals of the earphone device 200, and a recognition connector 175 for recognizing the connection of the earphone device 200. The terminal connectors 171, 172, 173 and 174 respectively come in contact with the microphone terminal M, the earphone ground terminal G, the earphone left terminal L, and the earphone right terminal R of the earphone head 210. The recognition connector 175 comes in contact with the earphone left terminal L. According to the present exemplary embodiment, the recognition connector 175 may be an element for use in connection of resistors of the earphone device 200 connected to the earphone left terminal L, the location of which may be changed. The recognition connector 175 may be connected to the earphone right terminal R according to an intention of a designer. On the other hand, the earphone interface 170 includes a distribution resistor Rd, which is connected in parallel to at least one resistor on a line connected to the earphone left terminal L, for distributing a pull-up voltage Vf, and a comparator 177 for outputting a result value according to an input distribution voltage.

The controller 160 includes a detector 161 connected to an output of the comparator 177, and recognizes the connection of the earphone device 200 based on signals transmitted to the detector 161. Upon identifying the connection of the earphone device 200 through the detector 161, the controller 160 controls the audio processor 130 to transmit the audio signals of the portable terminal 100 to the earphone device 200 through the earphone interface 170. On the other hand, when recognizing the connection of the earphone device 200 through the detector 161, the controller 160 controls the audio controller 130 to store and/or transmit audio signals, which the earphone device 200 collects through the earphone interface 170, to another portable terminal. The portable terminal 100 may include a communication unit (not shown) in order to transmit the audio signal to the other portable terminal. When the detector 161 detects a "High" signal of the comparator 177, then the controller 160 determines that the earphone device 200 is connected to the portable terminal 100. In a case where the output of the comparator 177 is a "Low" signal, then the controller 160 determines that the earphone device 200 is separated from the portable terminal 100.

The audio processor 130 supports an audio output function and an audio collection function of the earphone device 200 connected to the earphone interface 170 under a control of the controller 160. When receiving a signal corresponding to the connection of the earphone device 200 from the controller 160, the audio processor 130 outputs audio signals which are reproduced or received from an outside source, through the earphone interface 170. Further, when the controller 160 requests the audio processor 130 to collect audio in order to support the functions of the portable terminal 100, the audio processor 130 processes and transmits audio signals collected from the microphone terminal M of the earphone head 210 and transmits the audio signals to the controller 160. Under the control of the controller 160, the processed audio signals are stored and/or transmitted to the storage unit or the communication unit.

As described above, even if a part of the earphone device 200 is abnormally connected to the portable terminal 100 when the earphone device 200 is inserted in the portable terminal 100, then the earphone system 10 of the present exemplary embodiment may recognize the connection of the earphone device 200 by recognizing a separate device recognition element Rs.

Figure 3:
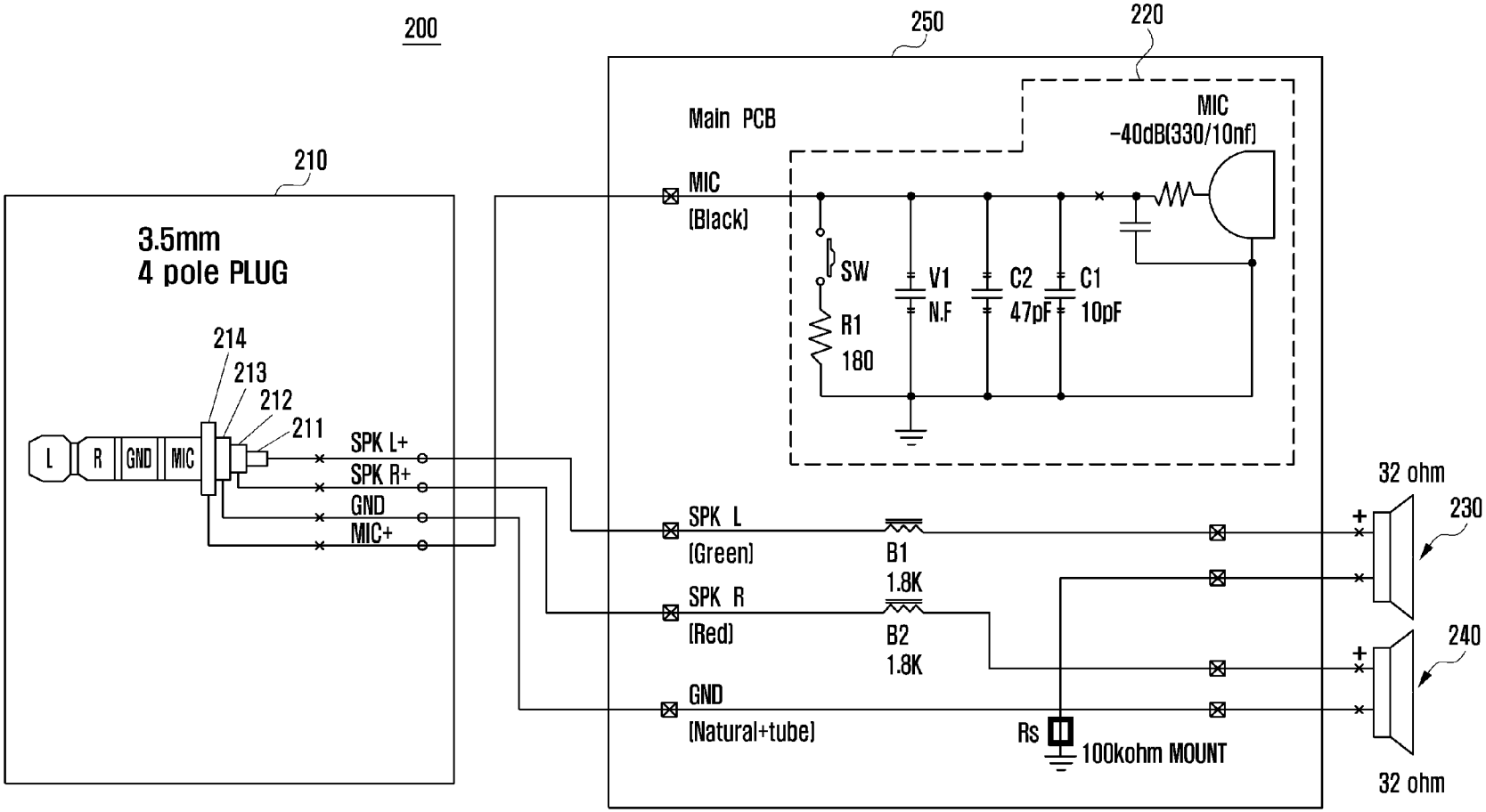
FIG. 3 is a circuit diagram illustrating a configuration of an earphone device in detail according to an exemplary embodiment of the present invention.

FIG. 3 is a circuit diagram showing a detail configuration of the earphone device according to the exemplary embodiment of the present invention.

Referring to FIGS. 2 and 3, the earphone device 200 of the present exemplary embodiment includes the earphone head 210, the control module 250, the earphone left output unit 230, and the earphone right output unit 240. The earphone device 200 may also include signal lines connecting the structural elements included in the earphone device 200.

As described above, the earphone head 210 has the earphone left terminal L, the earphone right terminal R, the earphone ground terminal G, and the microphone terminal M at a front end of the earphone head 210, which is inserted in the earphone interface 170. The earphone head 210 has electrodes corresponding to each terminal at a rear end thereof, which are respectively connected to each element of the earphone device 200 through the control module 250. An electrode 211 disposed at a center portion of the earphone head 210 is connected to the earphone left terminal L, an electrode 212 is adjacent to the electrode 211 and is connected to the earphone right terminal R, an electrode 213 is connected to the earphone ground terminal G, and an electrode 214 is connected to the microphone terminal M. In the aforementioned description, the earphone head 210 is described with reference to an earphone having the four terminals. However, the present invention is not limited thereto, and the earphone head 210 may have any suitable number of terminals, for example, in an earphone with three terminals, the microphone terminal M may be removed.

The earphone output units 230 and 240 have the predetermined resistance value, for example, the resistance value of about 32 ohms. The earphone output units 230 and 240 may be connected to the earphone head 210 through the control module 250. At this time, the control module 250 may have the device recognition element Rs disposed between the earphone head 210 and the earphone output units 230 and 240, as shown in FIG. 3. When the earphone head 210 is inserted in the earphone interface 170 of the portable terminal 100, the earphone device 200 of the present exemplary embodiment may allow the portable terminal 100 to easily recognize the earphone device 200, even though at least one of the earphone output units 230 and 240 is abnormally connected to the portable terminal 100.

In the aforementioned description, it is described that the device recognition element Rs is connected to both earphone left and right output units 230 and 240. However, the present invention is not limited to the above description. The device recognition element Rs may be connected to at least one of the earphone left and right output units 230 and 240.

As shown, the control module 250 includes the microphone 220 and signal lines arranged at a portion of the microphone 220. The signal lines include an earphone left signal line SPK L connected to the earphone left terminal L, an earphone right signal line SPK R connected to the earphone right terminal R, and a ground signal line GND connected to the earphone ground terminal G of the earphone head 210. The microphone 220 includes a switch SW, a resistor R1, capacitors C1 and C2, a voice signal collector V1, and other elements, as shown in FIG. 3.

In the earphone device 200 of the present invention having the aforementioned configuration, the earphone left terminal L comes in contact with the recognition connector 175 of the earphone interface 170 when the earphone head 210 is inserted in the earphone interface 170 of the portable terminal 100. Accordingly, the earphone left terminal L, the earphone left signal line SPK L, the device recognition device Rs and the earphone left output unit 230 may be connected to the recognition connector 175 of the earphone interface 170. Here, a sum resistance of the device recognition element Rs and the earphone output unit 230 is connected to the distribution resistor Rd in parallel. In order to have no effect on the earphone left output unit 230 that connected in parallel to the distribution resistor Rd, the device recognition element Rs may have a resistance value of several KΩ for example, about 100KΩ. Parallel resistance values 24Ω and 24Ω of the device recognition element Rs of 100 kΩ and the earphone left output unit 230 of 32Ω are connected in parallel to the distribution resistor Rd.

Here, since the distribution resistor Rd is designed to have a resistance value of several MΩ for example, about 1 MΩ, a voltage input to an input terminal of the comparator 177 corresponds to a voltage into which the pull-up voltage is divided in proportion to 24Ω and a resistance value of the distribution resistor Rd. The distribution voltage is relatively low in comparison with the pull-up voltage Vf, and is provided to the comparator 177. Accordingly, when a voltage that is lower than a reference voltage Vref is provided to the comparator 177, the comparator 177 outputs a "High" signal. The "High" signal may be provided to the detector of the controller 160.

In the aforementioned description, the device recognition element Rs has the resistance value of about 100KΩ. However, the present invention is not limited to the above description. In a case where the device recognition element Rs distributes the pull-up voltage Vf and provides the distribution voltage as an input voltage to the comparator 177, an inverse comparator 177 may be determined to be an element which is capable of outputting the "High" signal and a certain resistance value. When the device recognition element Rs has a resistance value larger than a predetermined value, leaked currents may increase. When the device recognition element Rs has the resistance value smaller than the predetermined value, then it has a relatively large size. Accordingly, a space for mounting the device recognition element Rs is restricted, and as a cost of resistor material increases, a manufacturing cost may also increase. The device recognition element Rs should be designed to have a desirable size with minimization of leaked currents and a resistance value of about 100KΩ or a certain value, in consideration of a mounting space and a manufacturing cost.

Figure 4:
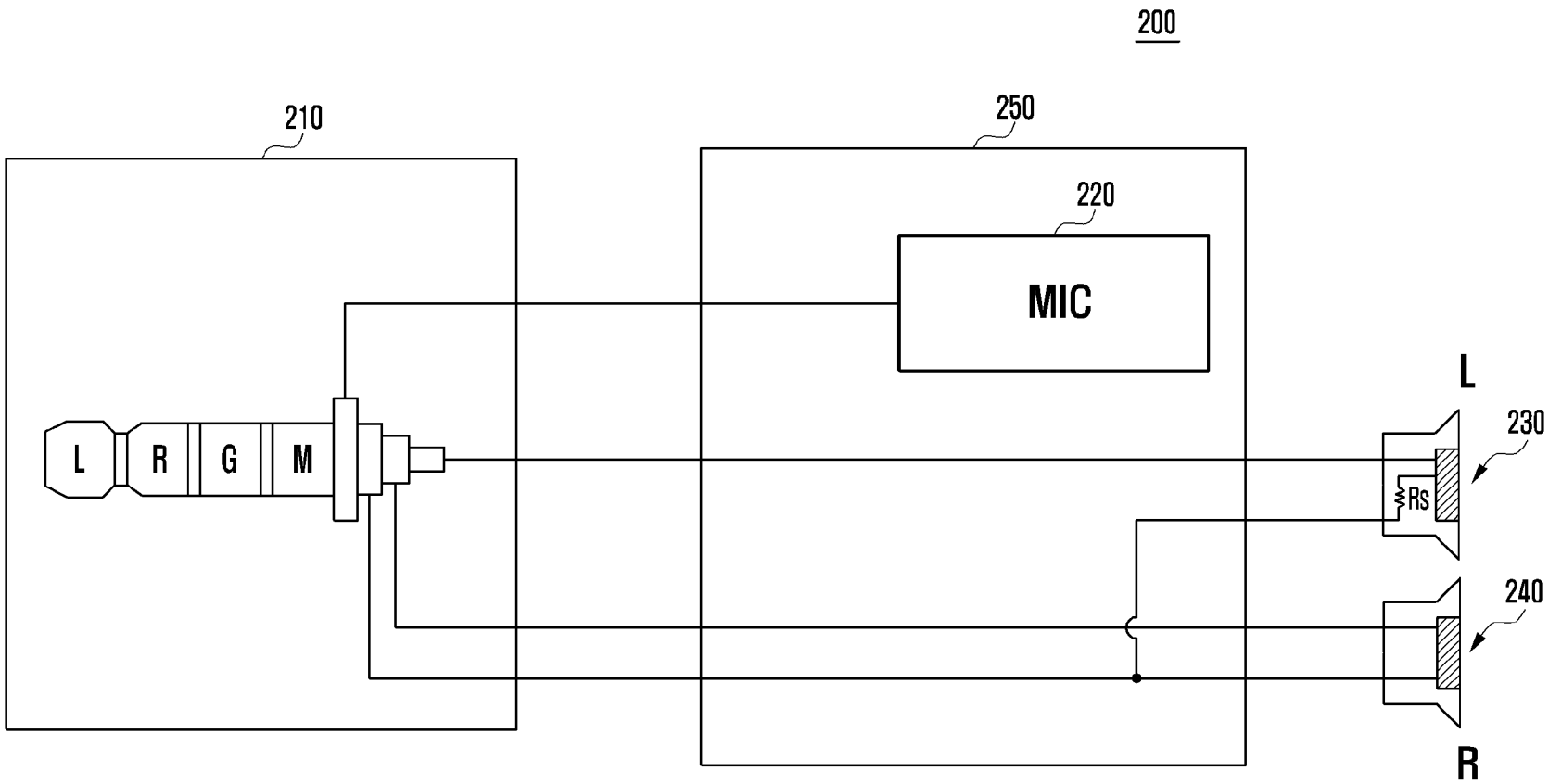
FIG. 4 is a view illustrating a configuration of an earphone device according to another exemplary embodiment of the present invention.

FIG. 4 is a schematic view illustrating a configuration of an earphone device according to another exemplary embodiment of the present invention.

Referring to FIG. 4, the earphone device 200 according to another exemplary embodiment of the present invention includes an earphone head 210, a control module 250, a microphone 220, an earphone left output unit 230 and an earphone right output unit 240. The earphone device 200 may further include a device recognition element Rs disposed in the earphone left output unit 230. Here, the earphone device 200 in which an earphone left terminal of the earphone head 210 is used for the recognition of an earphone connection will be described. However, the present invention is not limited to the earphone device 200 of the present exemplary embodiment, and the device recognition element Rs may be embedded in the earphone right output unit 240 in order to support that the portable terminal 100 recognizing an earphone connection through an earphone right terminal of the earphone head 210. Also, the device recognition element Rs of the earphone device 200 may be embedded in each of the earphone left output unit 230 and the earphone right output unit 240.

Since the earphone output units 230 and 240 are respectively connected to an end of the signal lines extending from the control module 250, they can be moved unless a user wears or fixes them on a user's ears. Therefore, any one of the earphone output units 230 and 240 which is not worn on the user's ear, or fixed to a certain position, may be easily collided against a surrounding object and the like, so as to be subjected to an impact. Such an impact may eventually cause malfunction of structural parts in the earphone output units 230 and 240. Particularly, due to the impact, parts relating to an audio signal output, from among parts of the earphone output units 230 and 240, such as an amplifier, an amplifier circuit, and the like, may be damaged.

Accordingly, the earphone output units 230 and 240 may not be recognized through the predetermined resistance value by the portable terminal because of the malfunction thereof. That is, the impact applied to the earphone output units 230 and 240 may cause the malfunction of the earphone output unit 230 and 240 so that the predetermined resistance value of the earphone output units 230 and 240 may not be recognized. Therefore, in the earphone device 200 of the present exemplary embodiment, the device recognition element Rs is embedded in at least one of the earphone output units 230 and 240, so as to support that the portable terminal 100 recognizing the connection of the earphone device using the resistance value of the device recognition element Rs embedded in the corresponding earphone output unit even though the earphone output units 230 and 240 cause malfunction themselves.

It has been assumed that the control module 250 of the earphone device 200 has a size to receive the device recognition element Rs. However, the control module 250 may have a restricted size according to intention of a designer or various purposes. Accordingly, the control module 250 may lack space to dispose the device recognition element Rs therein. On the other hand, the earphone output units 230 and 240 may need sufficient background space according to various purposes, for example, in order to process a howling with relation to output signals. Therefore, the earphone output units 230 and 240 may be designed to have a relatively large mounting space in comparison with the control module 250. In the earphone device 200 according to another exemplary embodiment of the present invention, the device recognition element Rs is embedded in the earphone output units 230 and 240 so as to support an enhanced recognition of the device. A manner of disposing the device recognition element Rs in the earphone output units 230 and 240 may be applied to a three-electrode type earphone. In the three-electrode type earphone, as a separate external microphone is not supported, the configuration of the microphone 220 and the control module 250 may be excluded. Accordingly, the device recognition element Rs may be disposed in the earphone output units 230 and 240.

As described above, the earphone output units 230 and 240 are disposed at an end of each signal line, and have a relatively large weight in comparison with the signal lines. Therefore, a connection point with each signal line may be weak against impact in comparison with other portions of the earphone device 200. Abnormalities and/or malfunctions, such as a short-circuit and the like, of the earphone output units 230 and 240 have a high probability of being generated at the connection points between the signal lines and the earphone output units 230 and 240 rather than the other portions. Accordingly, the device recognition element Rs is embedded in each of output units 230 and 240 so as to be disposed at each connection point between the signal lines and the earphone output units 230 and 240. As a result, the earphone device 200 of the present exemplary embodiment may support the portable terminal 100 in recognizing a connection of the earphone device 200 depending on the device recognition element Rs, even if the earphone output units 230 and 240 have a short-circuit caused on the signal lines.

Figure 5:
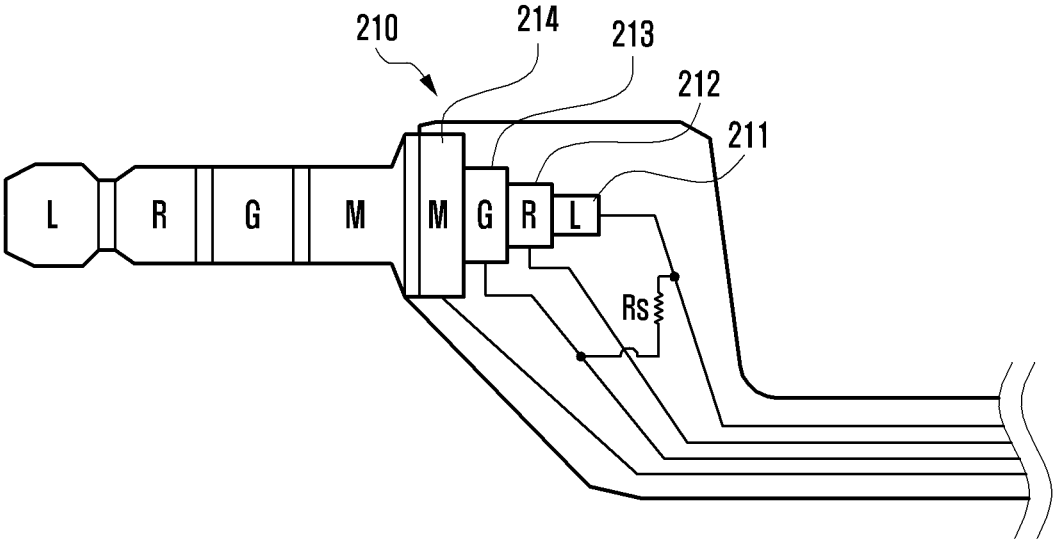
FIG. 5 is a view illustrating a configuration of a head of an earphone device in detail according to another exemplary embodiment of the present invention.

FIG. 5 is a schematic view showing a configuration of an earphone device according to another exemplary embodiment of the present invention.

Referring to FIG. 5, a device recognition element Rs of the present exemplary embodiment may be disposed in an earphone head 210. The earphone head 210 includes a front portion of the earphone head 210, which is made of a metal material and connected to an earphone interface 170 of a portable terminal 100, and a rear portion of the earphone head 210, which connects respective terminals of the earphone head 210 to other parts of the earphone device 200 such as a control module 250, earphone output units 230 and 240, etc. The front portion of the earphone head 210 is exposed to the outside in order to come in electrical contact with connectors formed on the earphone interface 170. On the other hand, the rear portion of the earphone head 210 may be coated with non-conductive material, for example, epoxy and the like, in consideration of a grasp of a user.

In the earphone device 200 of another exemplary embodiment of the present invention, the device recognition element Rs may be embedded in the rear portion of the earphone head 210, i.e. a portion of the earphone head 210 coated with epoxy so as to support that the portable terminal 100 in recognizing an insertion of the earphone device 200 regardless of the malfunction of the earphone device when the earphone device 200 is inserted in the portable terminal 100. The rear portion of the earphone head 210 is relatively strong against impact in comparison with other parts of the earphone device 200 because of being coated with a rigid material, such as the epoxy or any other similar and/or suitable material. Accordingly, as the device recognition element Rs is disposed in the rear portion of the earphone head 210, the earphone device 200 of the present exemplary embodiment may support recognition of the connection between the earphone device 200 and the portable terminal 100 regardless of an absence or presence of a short-circuit or a malfunction in the control module 250, the earphone output units 230 and 240, and the like.

Here, the device recognition element Rs may be disposed between an electrode 211 connecting an earphone left terminal L with an earphone left output unit 230 and an electrode 213 connected to an earphone ground terminal G. Otherwise, the device recognition element Rs may be disposed between an electrode 212 connecting an earphone right terminal R with an earphone right output unit 240 and an electrode 213 connected to the earphone ground terminal G. According to another exemplary embodiment, the device recognition element Rs may be disposed between at least one pair of electrodes 211, 212, 213 and 214, which are respectively connected to the earphone ground terminal G, the microphone terminal M, the earphone left terminal L and the earphone right terminal R. The disposal of the device recognition element Rs may be changed according to a design scheme of the portable terminal 100 capable of recognizing the earphone device 200.

As described above, the exemplary embodiment of the present invention in which the device recognition element Rs is disposed in the earphone device 200 in order to recognize the earphone device 200 has been described. Hereinafter, an exemplary embodiment of the present invention in which a device recognition element Rs is disposed in a portable terminal 100 will be described.

Figure 6:
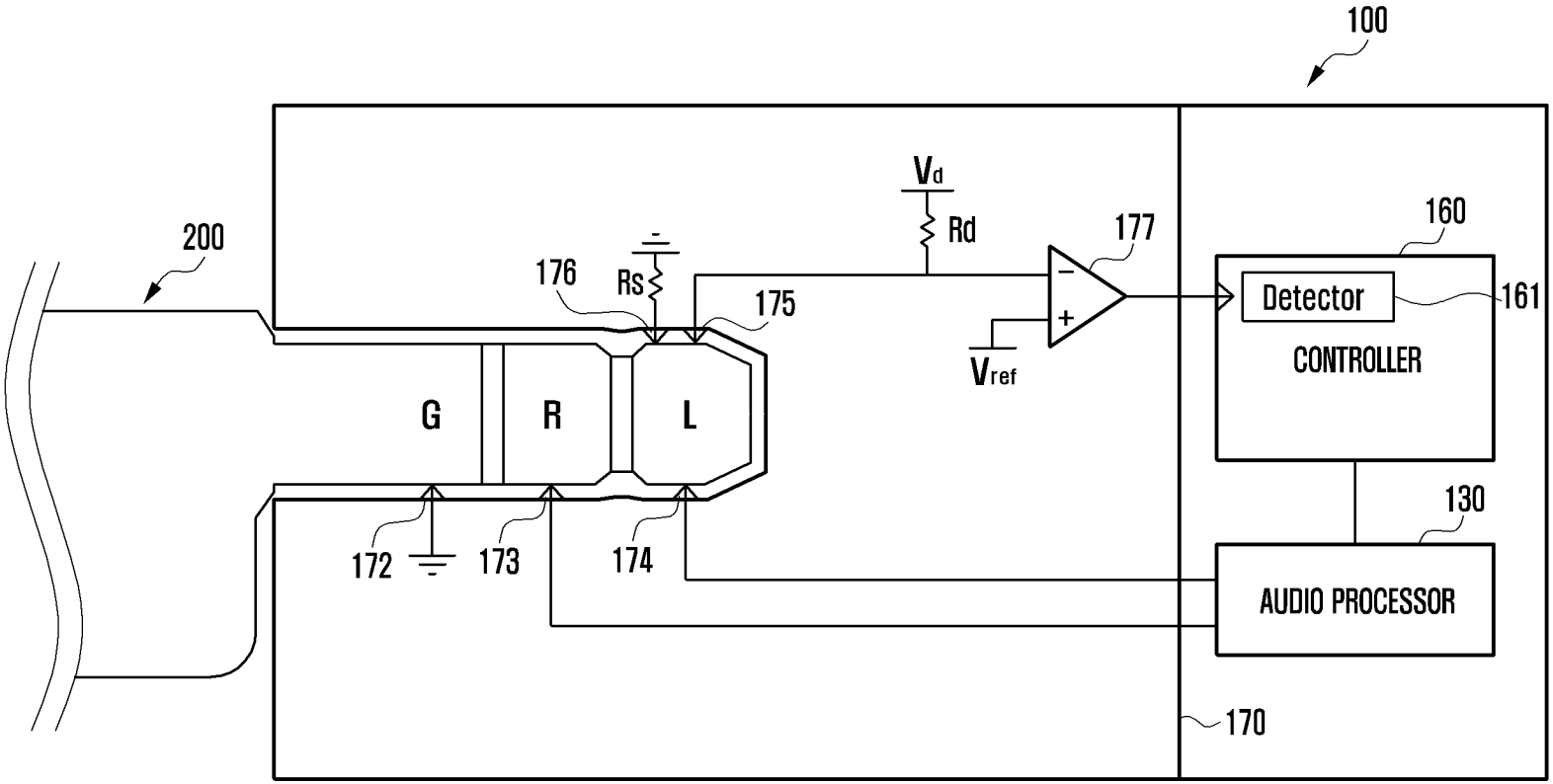
FIG. 6 is a view illustrating a configuration of the portable terminal according to an exemplary embodiment of the present invention.

FIG. 6 is a detailed view showing a configuration of the portable terminal according to an exemplary embodiment of the present invention.

Referring to FIG. 6, the portable terminal 100 of the present exemplary embodiment may include an earphone interface 170, a controller 160, and an audio processor 130. Also, the portable terminal 100 may include other elements (not shown) used for operation of the portable terminal 100, such as a storage unit, a communication unit, an input unit, a display unit, and the like, in order to support functions of the portable terminal 100. Especially, in the portable terminal 100, a device recognition element Rs may be disposed in the earphone interface 170 so as to support recognition of an earphone device 200. More particularly, the earphone interface 170 includes terminal connectors which come in contact with three or four or any suitable number of terminals of the earphone head 210. Also, the earphone interface 170 may include a recognition connector 175 for recognition a connection of the earphone device 200, and an element connector 176 for connecting the device recognition element Rs with the earphone head 210. Here, the exemplary embodiment of the present invention, which has three terminal connectors 172, 173 and 174 has been shown. However, the present invention is not limited thereto, and the earphone interface 170 may include four terminal connectors as described above with reference to FIG. 2.

The terminal connectors 172, 173 and 174, the recognition connector 175 and the element connector 176 respectively protrude at a predetermined height from an inner surface of the earphone interface 170. Accordingly, the terminal connectors 172, 173 and 174, the recognition connector 175 and the element connector 176 may come in contact with each terminal of the earphone head 210 when the earphone head 210 is inserted into the earphone interface 170. The recognition connector 175 and the device connector 176 may come in contact with the same terminal simultaneously. Therefore, when the earphone head 210 is inserted in the earphone interface 170, the recognition connector 175 and the element connector 176 may come in electrical contact with each other. The device recognition element Rs, which is connected to the element connector 176, is arranged in parallel with a distribution resistor Rd connected to the recognition connector 175. Therefore, a pull-up voltage Vf is distributed by the device recognition element Rs and the distribution resistor Rd, and the pull-up voltage Vf that is distributed is transmitted to an input end of a comparator 177.

The comparator 177 transmits a "High" signal to a detector 161 of the controller 160 if the pull-up voltage Vf sent to the input end is lower than a reference voltage Vref. Also, when the recognition connector 175 is electrically separated from the element connector 176 when the earphone device 200 is not inserted in the earphone interface 170, the comparator 177 transmits a "Low" signal, which is generated by the pull-up voltage Vf that is input to the input end of the comparator 177 through the distribution resistor Rd, to the controller 160. The comparator 177 has the reference voltage Vref that is lower than the pull-up voltage Vf.

In the description of the exemplary embodiment of FIG. 6, the element connector 176 comes in electrical contact with the recognition connector 175 as the earphone left terminal L of the earphone head 210 is inserted in the earphone interface 170. However, the present invention is not limited thereto, and the element connector 176 and the recognition connector 175 may be located at any place or position in the earphone interface 170 on the condition that the electric connection or separation between the element connector 176 and the recognition connector 175 may be achieved as the earphone head 210 is inserted in or separated from the earphone interface 170. For example, the element connector 176 and the recognition connector 175 may be arranged at a place where they may come in contact with the earphone right terminal R in common when the earphone head 210 is completely inserted in the earphone interface 170. Further, on the condition the earphone head 210 including a microphone terminal is inserted in the earphone interface 170, the element connector 176 and the recognition connector 175 may be disposed in an outermost region of the earphone interface where the microphone terminal is located.

In FIG. 6, the element connector 176 is disposed near an opening of the earphone interface 170 and in front of the recognition connector 175. However, the present invention is not limited thereto, and the element connector 176 and the recognition connector 175 may be arranged on the same circumference according to an intention of a designer. Therefore, the element connector 176 and the recognition connector 175 come in contact with a certain terminal at different places on the same circumference when a cylinder type earphone head 210 is inserted in the earphone interface 170. The device recognition element Rs connected to the element connector 176 may be connected in parallel with the distribution resistor Rd through a certain terminal and the recognition connector 175.

In the portable terminal 100 of the present exemplary embodiments having the configuration as described above, the device recognition element Rs for recognizing the earphone device is provided at a side of the earphone interface 170, so as to recognize the earphone device 200 when the earphone device 200, which has the earphone head 210 without a crushed part or foreign substance, is merely inserted in the earphone interface 170. Thereby, the device recognition element Rs may support an operation of the earphone device 200.

On the other hand, the display unit of the portable terminal 100 may output information of notifying of the insertion of the earphone device 200 when the earphone device 200 is inserted in the earphone interface 170. In this process, the display unit of the portable terminal 100 may output a screen corresponding to the functional support. Audio signals output to the earphone device 200 may be information relating to information output on the display unit. On the other hand, the display unit may be in a turned-off condition. At this time, the portable terminal 100 may support that reproduced or received audio signals are output to the earphone device 200.

In the aforementioned exemplary embodiment, the device recognition element Rs is disposed in each of the earphone device 200 and the portable terminal 100. However, the present invention is not limited thereto, and the device recognition element Rs may be disposed in at least one of the earphone head 210, the control module 250, and the earphone output units 230 and 240. Also, the device recognition element Rs may be arranged at a side of the earphone interface. Further, the device recognition elements Rs may be installed in both of the earphone device 200 and the portable terminal 100. In a case where a plurality of device recognition elements Rs are connected in parallel, a resistance value of the plurality of device recognition elements Rs decreases as the earphone device 200 is inserted in the portable terminal 100. Consequently, the resistance value of the plurality of device recognition elements Rs may be smaller than that of the distribution resistor Rd so that the comparator 177 may output the "High" signal when the earphone device 200 is inserted in the portable terminal 100.

The earphone system 10, which includes the portable terminal 100 and the earphone device 200 connected to the portable terminal 100 according to the present exemplary embodiments, supports that the portable terminal 100 recognizing the connection of the earphone device 200 so that a user may use at least one of the audio output units and the microphone which are normally operated. The earphone system 10 may support radio listening, music reproducing and listening, voice-calling, and the like even in a case where the earphone device 200 partially malfunctions. Especially, in the radio listening, one of the signal lines connected to the earphone output units 230 and 240 may be used as an antenna. In the earphone device 200 of the present exemplary embodiments, the signal lines connected to the earphone output units 230 and 240 may be used as the antenna even if abnormality is generated in the earphone output units 230 and 240.

Accordingly, the portable terminal 100 may support a radio function based on the corresponding earphone device 200. In addition, it is possible to design various earphone devices according to the arrangement location of the device recognition element Rs. Therefore, it is possible to solve problems of the design and a mounting space and also to freely decide a size, a shape and material of the device recognition element Rs. If the device recognition element Rs is arranged in the earphone device 200, the operation performance of the control module, which is sensitive to Time Division Multiple Access (TDMA) noise and the like, may be improved. That is, it is possible to reduce noise according to the arrangement of the device recognition element Rs.

The portable terminal 100 may include more additional modules according to a provided specification or design choice. That is, in a case of using the portable terminal 100 as a communication terminal, the portable terminal 100 may additionally include other elements, although not shown, such as a Near Field Communication (NFC) module for near field communication, an interface for transmission and reception of data depending on a wired or wireless communication scheme thereof, an Internet communication module for performing an Internet access in communication with the Internet, a digital broadcasting module for receiving and reproducing digital broadcasting, and the like. With a convergence trend of digital devices, these modules as mentioned above have a lot of variations, all of which cannot be listed. However, structural elements similar to the aforementioned modules may be additionally included in the digital devices. The portable terminal 100 of the present invention may exclude or replace certain structural elements with others depending on provided specification or design choice as would be understood by a person of ordinary skill in the art.

Furthermore, the portable terminal 100, according to the exemplary embodiments of the present invention, may be any suitable and or similar portable electronic device, such as information communication devices, multimedia devices, and applied devices thereof, which include a Portable Multimedia Player (PMP), a digital broadcasting player, a Personal Digital Assistant (PDA), a music player such as a Motion Picture Experts Group (MPEG)-1 Audio Layer 3 (MP3) player, a portable game terminal, a smart phone, a notebook, a hand-held Personal Computer (PC), and any other similar and/or suitable electronic device, as well as all mobile communication terminals which are operated by communication protocols corresponding to various communication systems.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A portable terminal for supporting an earphone device, comprising:

an earphone interface in which the earphone device is inserted;

a controller configured to determine whether the earphone device is connected to the earphone interface depending on a signal transmitted from the earphone interface; and an audio processor configured to support functions of the earphone device under a control of the controller, wherein the earphone interface comprises:

terminal connectors configured to come in contact a head of the earphone device;

an element connector configured to come in contact with a certain terminal of an earphone head and a device recognition element connected to an element connector, when the earphone head is inserted in the earphone interface;

a recognition connector connected to the certain terminal with which the element connector comes in contact, the recognition connector configured to recognize the connection of the earphone device, and a distribution resistor connected to the recognition connector, the distribution resistor configured to distribute a pull-up voltage with the recognition connector; and a comparator connected to the distribution resistor, wherein the element connector and the recognition connector are configured to come in contact with one of an electrode connected to an earphone left terminal, and an electrode connected to an earphone right terminal.

2. The portable terminal for supporting an earphone device as claimed in claim 1, wherein the terminal connectors comprise:

a group of electrodes which are respectively connected to each of the earphone left terminal, the earphone right terminal and an earphone ground terminal of the earphone head, or a group of electrodes which are respectively connected to each of the earphone left terminal, the earphone right terminal, an earphone ground terminal and a microphone terminal of the earphone head.

3. The portable terminal for supporting an earphone device as claimed in claim 2, wherein the element connector and the recognition connector are further configured to come in contact with an electrode connected to the microphone terminal.

4. The portable terminal for supporting an earphone device as claimed in claim 1, wherein the comparator is configured to:

receive an input voltage of the pull-up voltage distributed by the distribution resistor and the device recognition element connected to the element connector, output a "High" signal corresponding to the received input voltage, when the earphone device is inserted in the earphone interface, while receiving the pull-up voltage as an input through the distribution resistor and output a "Low" signal corresponding to the received input, when the earphone device is separated from the earphone interface.

5. The portable terminal for supporting an earphone device as claimed in claim 1, wherein a earphone left and right output units of the earphone device respectively have an inherent resistance value of several ohms, the device recognition element has a resistance value of several Kilo ohms, and the distribution resistor has a resistance value of several Mega ohms.

* * * * *